United States Patent [19]

Weiser

[11] Patent Number: 4,665,375

[45] Date of Patent: May 12, 1987

[54] ELECTROMAGNETIC RELAY

[75] Inventor: Josef Weiser, Hohenschaeftlarn, Fed. Rep. of Germany

[73] Assignee: Siemens Aktiengesellschaft, Berlin and Munich, Fed. Rep. of Germany

[21] Appl. No.: 824,106

[22] Filed: Jan. 30, 1986

[30] Foreign Application Priority Data

Feb. 12, 1985 [DE] Fed. Rep. of Germany ..... 3504745

[51] Int. Cl.[4] ..... H01H 51/22

[52] U.S. Cl. ..... 335/78; 335/83; 335/128; 335/133

[58] Field of Search ..... 335/78, 79, 80, 81, 335/82, 83, 128, 133, 88, 99

[56] References Cited

U.S. PATENT DOCUMENTS

| | | | |
|---|---|---|---|
| 2,825,783 | 3/1958 | Sauer | 335/80 |
| 3,355,629 | 11/1967 | Schapira | 335/128 X |
| 4,216,452 | 8/1980 | Arnoux et al. | 335/133 X |
| 4,482,876 | 11/1984 | Stadler et al. | 335/83 |
| 4,491,813 | 1/1985 | Kimpel et al. | 335/187 |
| 4,509,025 | 4/1985 | Kimpel et al. | 335/85 |
| 4,540,963 | 9/1985 | Esterl et al. | 335/133 |

FOREIGN PATENT DOCUMENTS 0046148 8/1980 European Pat. Off. .

*Primary Examiner*—Patrick R. Salce
*Assistant Examiner*—Anita M. Ault
*Attorney, Agent, or Firm*—Hill, Van Santen, Steadman & Simpson

[57] ABSTRACT

An electromagnetic relay has a flat base, a coil body with flanges at opposite ends disposed on said base, a coil wound about the coil body between the flanges, a carrier element of insulating material pivotally seated in one of the flanges with an armature attached thereto and extending therefrom through said coil, contact springs disposed parallel to said armature outside of said coil body, and cooperating contact elements anchored in said base body for making electrical contact with the contact springs. A magnet system is provided for actuating the armature, and upon actuation of the armature the carrier is rotated thereby moving the contact springs for simultaneously contacting the contact elements. The contact springs are electrically connected inside the carrier forming a contact bridge electrically connecting the cooperating contact elements upon actuation of the springs, dependent upon the switch position of the armature. By simultaneously making electrical connection with two contact elements, the bridged contact springs are suitable for switching high currents without the use of additional power leads connected to the springs.

6 Claims, 4 Drawing Figures

ELECTROMAGNETIC RELAY

BACKGROUND OF THE INVENTION

1. Field of the Invention

The present invention relates to an electromagnetic relay, and in particular to an electromagnetic relay having a carrier element pivotally mounted in a coil flange, an armature connected to the carrier element extending through the coil, and contact springs disposed outside of the coil parallel to the armature and also connected to the carrier element.

2. Description of the Prior Art

An electromagnetic relay is disclosed in German OS No. 31 32 239, corresponding to U.S. Pat. No. 4,491,813, having a flat base body with a coil body having flanges at opposite ends thereof, a coil wound about the coil body, a bar-shaped armature disposed axially within the coil and having one end thereof connected to an insulating armature carrier and the other end switchable between two pole plates in the region of the opposite coil flange. In one embodiment described in this patent, two contact springs are also connected at opposite sides of the carrier, disposed substantially parallel to the armature outside of the coil. The free ends of the contact springs make and break electrical connections with at least one cooperating contact element anchored in the base body. A magnet system is provided for actuating the armature, actuation of the armature causing pivoting of the carrier element and thereby causing corresponding movement of the carrier springs toward and away from the anchored contact elements.

In this relay system, additional actuating members, which are necessary in other types of relays, are not needed due to the direct fastening of the contact springs in the armature carrier. A switching contact is formed at both sides of the coil, and the contact spring secured in the armature carrier is connected to a terminal element via a flexible power lead. During fabrication of such a relay, this power lead requires expenditure for additional parts and assembly steps. Moreover, the presence of such a power lead limits the relay for switching relatively weak currents.

SUMMARY OF THE INVENTION

It is an object of the present invention to provide an electromagnetic relay having a pivotable armature carrier with an armature and two contact springs secured thereto for co-movement therewith which provides the necessary insulating paths for switching high currents.

It is a further object of the present invention to provide such a relay wherein the number of individual parts and manufacturing steps is reduced.

The above objects are inventively achieved in an electromagnetic relay wherein the two contact springs on opposite sides of the armature have an electrically conductive connection between the springs so that the springs function in common as a contact bridge without the necessity of a separate connection between the two cooperating contact elements anchored in the relay base. Upon actuation of the armature and corresponding movement of contact springs, a bridge switch over contact is formed between the cooperating contact elements anchored in the relay base at each switch position.

The unification of the two moveable contact springs secured in the armature carrier to form a single bridge contact element achieves the advantage associated with bridge contacts, namely doubling the contact spacing given the same armature stroke. This permits higher currents to be switched. Moreover, the flexible power leads required in relays such as that described in U.S. Pat. No. 4,491,813 are eliminated in the structure disclosed herein. Should any additional resilient element be necessary, such an element can be fabricated of plastic.

The total number of individual parts of the relay can be further reduced by embedding a connecting section between the contact springs in the armature carrier, thereby forming a one piece unit. Instead of two separately fabricated contact springs, which would be connected to each other in a subsequent manufacturing step, only a single part is punched from sheet metal and embedded in the armature carrier.

In a further embodiment of the relay, the base body has insulating partitions disposed at the opposite sides of the coil between the coil winding and the contact elements. The insulating path between the switch contacts and the excitation winding is thereby increased so that still higher currents can be switched. The insulating path can be further increased by the use of an insulating rib disposed on the relay base between the cooperating contact elements anchored in the relay base. Additionally, a protective cap, inverted over the coil assembly and the contact elements, may also have insulating walls or partitions extending downwardly from a top of the cap between the coil winding and the contact elements on each side of the coil.

If the relay disclosed herein is provided with a polarized magnet system, such as described in aforementioned U.S. Pat. No. 4,491,813, it is possible to further improve switching function of the relay for high currents. A flat permanent magnet may be disposed above the coil having at least four poles between two yokes connected to the pole plates, and a flux plate coupled to the pivotable end of the armature extending beyond the width of the coil at each side. The flux plate forms an additional free pole surface over the contact locations. The blowout effect of a magnet, which is used in polarized relays and other contactor devices, can be exploited. The arc which results when contacts are open is laterally deflected and dissipates sooner due to the extension of the magnet. The magnet poles additionally present for the blowout effect are preferably polarized in the same directions as the adjacent poles disposed over a yoke, so that the field lines of the free poles are deflected down and away from the yoke.

DESCRIPTION OF THE PREFERRED EMBODIMENTS

Figure 1:
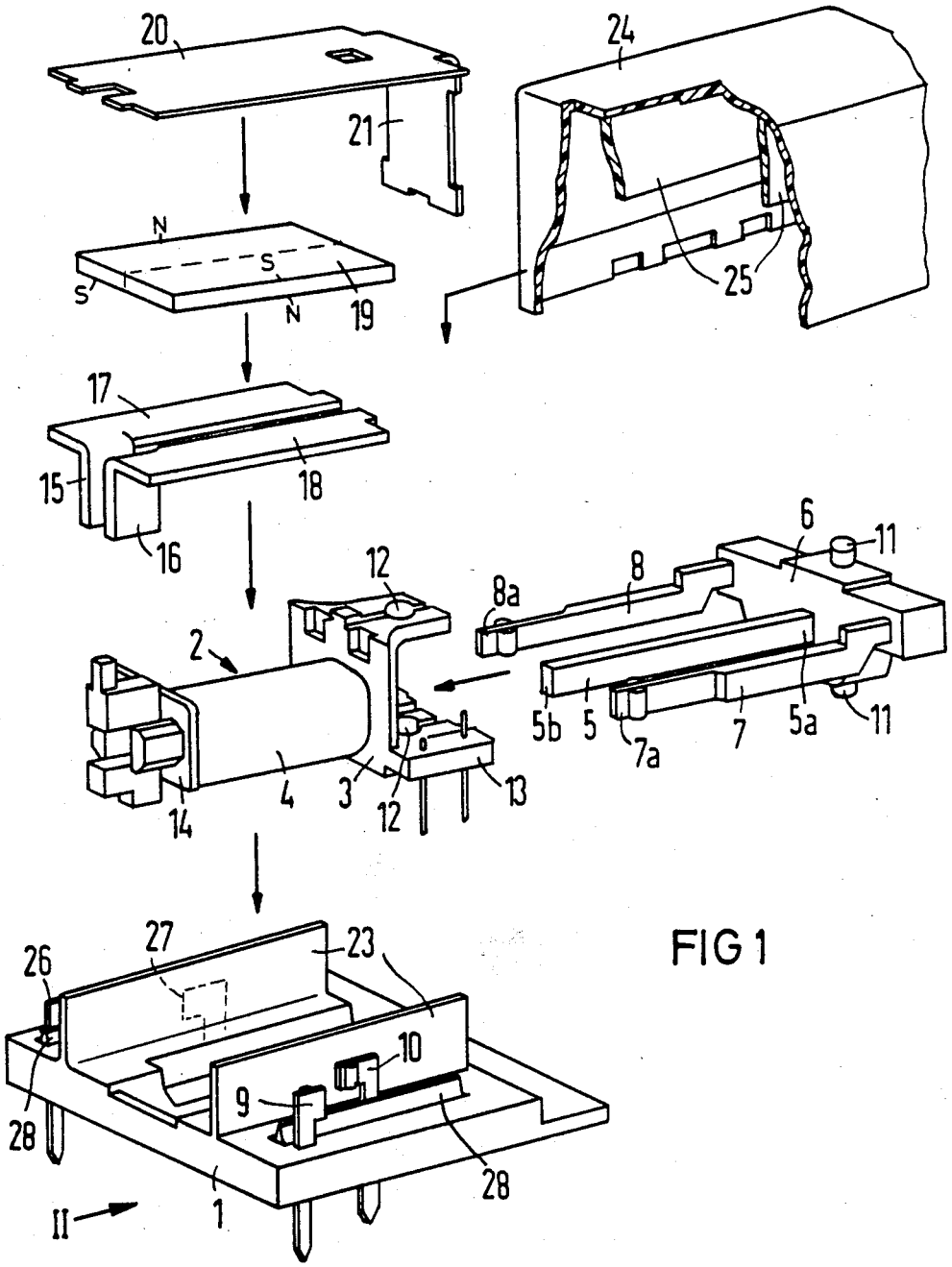
FIG. 1 is an exploded view of a polarized electromagnetic relay constructed in accordance with the principles of the present invention.
Figure 2:
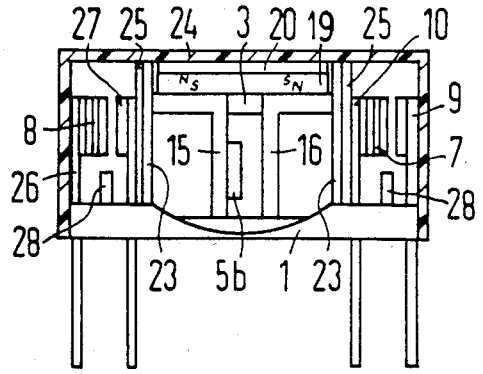
FIG. 2 is a schematic front view of an assembled relay constructed in accordance with the principles of the present invention seen in the direction of arrow II in FIG. 1, with the cover end section.
Figure 3:
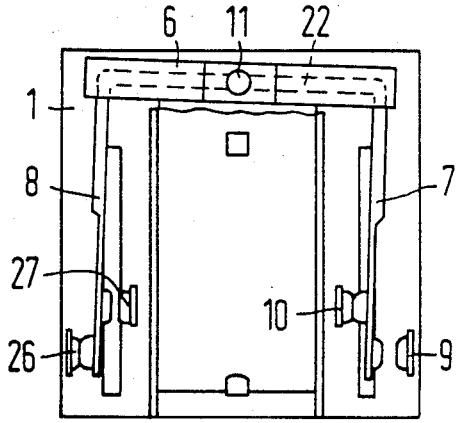
FIG. 3 is plan view of the assembled relay of FIG. 2 with the cover removed and with the flux plate and coil member partly broken away.

The relay constructed in accordance with the principles of present invention shown in FIGS. 1, 2 and 3 has a flat base body 1 with a coil assembly 2 including a coil body 3 with spaced flanges 13 and 14 with a winding 4 therebetween disposed on the base body 1. A bar-shaped armature 5 extends into the coil assembly 2 through an axial opening therein, with one end 5*a* of the armature 5 being secured in an armature carrier 6 of insulating material. Two contact springs 7 and 8 are also secured in the armature carrier 6 at opposite sides of the armature and extending substantially parallel thereto. The free end 7*a* of the contact spring 7 is moveable for switching between two cooperating contact elements 9 and 10 anchored in the base body 1, and the free end 8*a* of the contact spring 8 is similarly moveable for switching between two other cooperating contact elements 26 and 27 also anchored in the base body 1.

In order to permit rotation of the armature carrier 6 for switching the contact elements 7 and 8, the armature carrier 6 has bearing axials or necks 11 received in spaced bearing bushings 12 in the flange 13. In the region of the opposite coil flange 14, the free end 5*b* of the armature 5 is switchable between two pole plates 15 and 16. The pole plates 15 and 16 extend to form two yokes 17 and 18, which are bent in a plane parallel to the plane of the base body 1, and rest against a pole of a flat four-pole permanent magnet 19. The poles of the permanent magnet 19 which are opposite each other are coupled to a flux plate 20, which forms a flux return path to the armature end 5*a* through an angled extension 21. The relay described thus far corresponds to one embodiment of the relay described in the aforementioned U.S. Pat. No. 4,491,813.

In accordance with the principles of the present invention, as best seen in FIG. 3, the two contact springs 7 and 8 are electrically connected by an integral connecting element 22 and are secured thereby in the armature carrier 6. The contact springs 7 and 8 thus form a contact bridge which, dependent upon the switching position of the armature, either connects the anchored contact element 26 to the anchored contact element 10 or connects the anchored contact element 9 to the anchored element 27. A separate power connection in the form a flexible lead for the contact bridge is, thus, not necessary.

In order to achieve adequate insulation from the coil winding when switching high currents, insulating partitions 23 may be formed as part of the base body 1 extending at the opposite sides of the coil winding up to the top of an insulating cover 24. The cover 24 may be provided with additional downwardly extending partitions 25, the partitions 25 being disposed next to the partitions 23 when the cover 24 is in place. Additionally, respective insulating ribs 28 may also be formed on the base body 1 between the anchored contact elements 9 and 10 and the anchored contact elements 26 and 27. The insulating rib 28 achieves further lengthening of the creep path.

Figure 4:
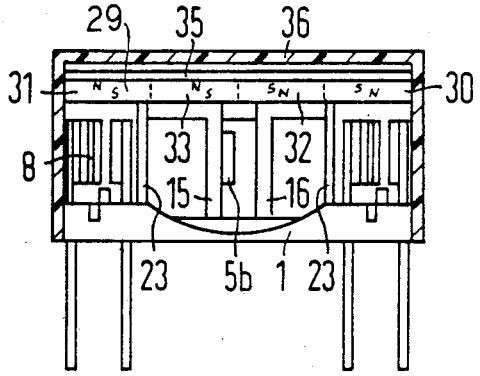
FIG. 4 is a front view of a further embodiment of a relay constructed in accordance with the principles of the present invention with the cover end section.

A further embodiment of the structure described herein is shown in FIG. 4. In this embodiment, the permanent magnet 29 is extended at both sides to provide pole surfaces 30 and 31, in addition to pole surfaces 32 and 33 required for the switching function. In order to achieve a downward deflection of the flux from the pole surfaces 30 and 31 and guide the flux to the switching paths between the respective cooperating contact elements 9 and 10 and the cooperating contact elements 26 and 27, the pole surfaces 30 and 31 are polarized in the same directions as the pole surfaces 32 and 33 to which they are respectively adjacent. In order to intensify the flux, a flux plate 35 disposed above the permanent magnet 29 is also extended so as to cover the entire upper side of the permanent magnet 29. In this embodiment, the partitions 23 of the base body 1 can extend only to the permanent magnet 29, and the partitions 25 shown in FIG. 1 cannot be provided.

Although modifications and changes may be suggested by those skilled in the art it is the intention of the inventor to embody within the patent warranted hereon all changes and modifications as reasonably and properly come within the scope of their contribution to the art.

I claim as my invention:

1. In an electromagnetic relay having a flat base, a hollow coil body with two spaced flanges and a winding therebetween, a carrier of insulating material pivotally mounted at one of said flanges, a bar-shaped armature having one end secured in said carrier and a free-end extending axially into said winding, a magnet system including two spaced pole plates disposed on opposite sides of said free-end of said armature for actuating said armature, two contact springs secured in said carrier parallel to and on opposite sides of said armature outside of said coil, and at least one cooperating contact element anchored in said base disposed on each side of said coil for simultaneously respectively making and breaking with said contact springs upon actuation of said armature, the improvement comprising:

an electrically conductive connection between said contact springs forming a bridge connection at one switch position of said contact springs between said cooperating contact elements; and an additional cooperating contact element anchored in said base disposed on each side of said coil with each contact spring being disposed between the cooperating contact elements on each side of said coil, said contact springs bridging one cooperating contact element on one side of said coil with another cooperating contact element on the other side of said coil at each switching position.

2. The improvement of claim 1, wherein said contact springs and said electrically conductive connection are integrally formed as a one-piece element embedded in said carrier.

3. The improvement of claim 1, further comprising:

insulating partitions extending from said base on both sides of said coil between said winding and said cooperating contact elements.

4. The improvement of claim 1, further comprising:

a cover received over said base and the components thereon having insulating partitions extending downwardly from a top of said cover between said winding and said cooperating contact elements.

5. The improvement of claim 1, further comprising:

two insulating ribs extending from said base respectively disposed between the cooperating contact elements on a same side of said winding.

6. A relay as claimed in claim 1, wherein said magnet system further includes two yokes respectively connected to said pole plates and a flux plate coupled to said armature, and further comprising:

a permanent magnet having at least four poles disposed between and magnetically coupled to said two yokes and said flux plate and said permanent magnet extending beyond said winding at each side thereof and having respective additional free pole surfaces disposed over said contact springs.

* * * * *